US005616021A

United States Patent [19]

Onimaru et al.

[11] Patent Number: 5,616,021

[45] Date of Patent: Apr. 1, 1997

[54] FUEL BURNING HEATER

[75] Inventors: Sadahisa Onimaru, Chiryu; Takashi Inoue; Masanori Yasuda, both of Okazaki; Hiroshi Okada, Kariya, all of Japan

[73] Assignee: Nippon Soken Inc., Nishio, Japan

[21] Appl. No.: 530,736

[22] Filed: Sep. 19, 1995

[30] Foreign Application Priority Data

Sep. 19, 1994 [JP] Japan ..... 6-251199

[51] Int. Cl.[6] ..... F23M 9/00

[52] U.S. Cl. ..... 431/115; 431/9; 431/12; 431/90

[58] Field of Search ..... 431/8, 12, 9, 90, 431/115

[56] References Cited

U.S. PATENT DOCUMENTS

| | | | |
|---|---|---|---|
| 3,934,969 | 1/1976 | Noda et al. | 431/115 X |
| 4,030,874 | 6/1977 | Vollerin | 431/12 X |
| 4,538,985 | 9/1985 | Zwicker . | |
| 5,088,918 | 2/1992 | Schaale et al. . | |

FOREIGN PATENT DOCUMENTS

| | | | |
|---|---|---|---|
| 331918 | 9/1989 | European Pat. Off. . | |
| 0428373 | 5/1991 | European Pat. Off. | 431/12 |
| 3829664 | 1/1990 | Germany | 431/12 |
| 1262214 | 10/1989 | Japan . | |
| 473503 | 3/1992 | Japan . | |
| 4214105 | 8/1992 | Japan . | |

*Primary Examiner*—Carl D. Price

*Attorney, Agent, or Firm*—Cushman Darby & Cushman Intellectual Property Group of Pillsbury Madison & Sutro LLP

[57] ABSTRACT

A fuel burning heater comprises a housing 1 provided with a fluid passage 13 defined in a wall thereof, and a burner 2 accommodated in an inside space of the housing 1 to heat fluid filled in the fluid passage 13. A fuel supply device 3 supplies fuel into the burner 2. An air supply device 4, including an air supply pipe 41, supplies air into the burner 2. An exhaust gas circulating device 5 circulates exhaust gas, produced in the burner 2 by combustion of air-fuel mixture, to the air supply pipe 41. A control unit 7 increases an amount of the exhaust gas circulated by the exhaust gas circulating device 5 when an amount of fuel supplied by the fuel supply device 3 is reduced.

11 Claims, 6 Drawing Sheets

LARGE HEATING POWER
LARGE
SMALL HEATING POWER
FUEL SUPPLY AMOUNT
SMALL
TIME

AIR SUPPLY AMOUNT
TIME

DAMPER OPENING
OPEN
CLOSE
TIME

OXYGEN DENSITY
HIGH
LOW
TIME

FUEL BURNING HEATER

BACKGROUND OF THE INVENTION

1. Field of the Invention

This invention relates to a fuel burning heater, and more particularly to a fuel burning heater having a controlled burning stability in which a stable burning condition is maintained regardless of occasional changes of heating power.

2. Related Art

A typical fuel burning heater is equipped with a burner which diverts a portion of the fuel to be supplied to a combustion engine to the heater and burns the fuel to increase the temperature of water circulated in the heater. The heated water passes into a heat radiating unit, and the heated water exchanges heat with air introduced in the heat radiation unit, thereby supplying warm temperature air into a passenger compartment. This kind of fuel burning heater is an auxiliary heating device used for a short and limited duration from a cold start-up of the engine until the engine is warmed up.

More specifically, the burner of such a fuel burning heater vaporizes the fuel supplied therein, mixes up the vaporized fuel with an air introduced therein, and burns the mixture of vaporized fuel and air by means of an appropriate igniter such as a glow plug.

FIG. 5 is a cross-sectional view showing an overall arrangement of a conventional fuel burning heater. In the drawing, a housing 1 is formed with a fluid passage 13 defined in the wall thereof, and accommodates a burner 2 in the inside space surrounded by the wall. The burner E has a mixing cylinder 21 having a closed distal end equipped with a plate-like vaporization member 81 made of ceramic fiber, the vaporization member 81 extending across the mixing cylinder 21. The vaporization member 81 is brought into contact with one end of a fuel supply pipe 33. The other end of the fuel supply pipe 33 is connected to a fuel pump 32 provided in a fuel tank 31. Thus, fuel in the fuel tank 31 is sucked up by the fuel pump 32 and introduced into the vaporization member 81. The fuel supplied into the vaporization member 81 spreads or diffuses across the entire body thereof, aided by the capillary phenomenon. A glow plug 82 is located adjacently to the vaporization member 81, so as to heat the vaporization member 81. Thus, the vaporized fuel is generated from the vaporization member 1 and then mixed with air in an inside space of the mixing cylinder 21, the air being introduced through air inlet holes 211.

More specifically, the air flows into the inside space of housing 1 from an inlet port 14 formed on an upper wall of the housing 1, the inlet port 14 communicating with an air supply pipe 41. The introduced air enters into the mixing cylinder 21 and is mixed with the vaporized fuel of the vaporization member 81, and then thus formed gas mixture of fuel and air is fired in a burning cylinder 22. Exhaust gas, generated in the burner 2 through combustion of the gas mixture, is discharged or scavenged from an exhaust port 15 formed on the lower wall of the housing 1, the exhaust gas flowing along an exhaust pipe 81 and going out of this fuel burning heater system.

An air pump 42 is provided in the air supply pipe 41 to adjust the air amount to be supplied into the burner 2. As well as the fuel pump 32, the air pump 42 is controlled by a control unit 7 so as to obtain a desired heating power.

This kind of fuel burning heater is, for example, disclosed in the unexamined Japanese patent application No. 1-262214/1989, the unexamined Japanese patent application No. 4-73503/1992, the unexamined Japanese patent application No. 4-214105/1992, or the U.S. Pat. No. 4,538,985.

In operation, the heating power of the above described conventional fuel burning heater is generally reduced with increasing temperature of the passenger compartment or the like. To realize such an adjustment, the fuel supply amount of the fuel pump 32 is reduced as shown in FIG. 6A, while the air supply amount of the air pump 42 is correspondingly reduced as shown in FIG. 6B, thereby maintaining an air-fuel ratio of the gas mixture at an appropriate value.

However, simply reducing air supply amount to be entered into the burner 2 causes reduction in the air flow speed and pressure, which correspondingly induces variations in a burning pressure of the burner 2 and a ram pressure upstream of the air pump 42, with possibly variation of an air supply amount to be supplied into the burner 2 due to the influences thus caused.

To solve this problem, it may be possible to adjust the heating power of the burner by the ON-OFF control of the burner which periodically repeats an ignition of the burner and an extinction of the same. However, such an ON-OFF control of the burner is not desirable in that harmful emission of HC (hydro-carbon) increases due to incomplete combustion of the air-fuel gas mixture derived from the intermittent firing of the burner.

SUMMARY OF THE INVENTION

Accordingly, in view of above-described problems encountered in the related art, a principal object of the present invention is to provide a fuel burning heater capable of stabilizing a burning condition and preventing emission from worsening even if the heating power is arbitrarily changed.

In order to accomplish this and other related objects, a first aspect of the present invention provides a fuel burning heater comprising: a housing provided with a fluid passage defined in a wall thereof; a burner accommodated in an inside space of the housing to heat fluid filled in the fluid passage; fuel supply means for supplying fuel into the burner; air supply means for supplying air into the burner, the air supply means including an air supply pipe; exhaust gas circulating means for circulating exhaust gas, produced in the burner by combustion of air-fuel mixture, to the air supply pipe; and circulating amount control means for increasing an amount of the exhaust gas circulated by the exhaust gas circulating means when an amount of the fuel supplied by the fuel supply means is reduced.

In the above first aspect fuel burning heater, it is desirable that the circulating amount control means controls the amount of the exhaust gas circulated by the exhaust gas circulating means so as to maintain a total amount of fluid flowing in the air supply pipe at a constant value regardless of change of an amount of the fuel supplied by the fuel supply means.

Furthermore, it is desirable that the exhaust gas circulating means comprises a circulating pipe for circulating the exhaust gas from an exhaust pipe to the air supply pipe, and an open-and-close valve for adjusting a circulation amount of the exhaust gas circulated through the circulating pipe.

Still further, it is preferable that the above fuel burning heater further comprises an oxygen density detecting means for detecting an oxygen density in the air supply pipe, and the circulating amount control means controls the exhaust gas circulating means to adjust the circulation amount of the exhaust gas based on a signal obtained from the oxygen density detecting means in such a manner that an oxygen amount supplied through the air supply pipe is adequate to form the gas mixture of a desired air-fuel ratio.

Yet further, it is desirable that the circulating amount control means maintains the total volume of fluid introduced into the burner at a constant value.

A second aspect of the present invention provides a fuel burning heater comprising: a housing provided with a fluid passage defined in a wall thereof; a burner accommodated in an inside space of the housing to heat fluid filled in the fluid passage; fuel supply means for supplying fuel into the burner; air supply means for supplying air into the burner, the air supply means including an air supply pipe provided with an air pump; exhaust gas circulating means for circulating exhaust gas, produced in the burner by combustion of air-fuel mixture, to the air supply pipe, the exhaust gas circulating means including an exhaust gas circulating pipe connected to the air supply pipe at a portion upstream of the air pump and an adjusting member for adjusting a circulating amount of the exhaust gas circulated through the exhaust gas circulating pipe; and circulating amount control means for controlling the adjusting member of the exhaust gas circulating means so as to increase the circulating amount of the exhaust gas when an amount of the fuel supplied by the fuel supply means is reduced, while an output of the air pump is maintained at a constant value regardless of change of fuel supply amount.

In the above second aspect fuel burning heater, it is desirable that the circulating amount control means controls the adjusting member of the exhaust gas circulating means in such a manner that an oxygen density supplied to the burner is reduced in proportion to reduction of the amount of the fuel supplied by the fuel supply means, or that an oxygen density detecting means is provided downstream of the air pump for detecting an oxygen density in the air supply pipe and the circulating amount control means controls the adjusting member of the exhaust gas circulating means to adjust the circulation amount of the exhaust gas based on a signal obtained from the oxygen density detecting means in such a manner that an oxygen amount supplied through the air supply pipe is adequate to form the gas mixture of a desired air-fuel ratio.

Moreover, a third aspect of the present invention provides a fuel burning heater comprising: a housing provided with a fluid passage defined in a wall thereof; a burner accommodated in an inside space of the housing to heat fluid filled in the fluid passage; fuel supply means for supplying fuel into the burner; air supply means for supplying air into the burner, the air supply means including an air supply pipe; exhaust gas circulating means for circulating exhaust gas, produced in the burner by combustion of air-fuel mixture supplied by the fuel supply means and the air supply means, to the air supply pipe; and compensating means for increasing an amount of the exhaust gas circulated by the exhaust gas circulating means when an amount of the fuel supplied by the fuel supply means is reduced, so as to reduce an amount of the air introduced into the burner in proportion to reduction of the amount of the fuel supplied by the fuel supply means, without changing a total amount of fluid supplied through the air supply pipe into the burner.

In the above third aspect fuel burning heater, it is desirable that the exhaust gas circulating means comprises a circulating pipe for circulating the exhaust gas from an exhaust pipe to the air supply pipe, and an open-and-close valve for adjusting a circulation amount of the exhaust gas circulated through the circulating pipe, or that an oxygen density detecting means is provided for detecting an oxygen density in the air supply pipe, and the compensating means controls the exhaust gas circulating means to adjust the circulation amount of the exhaust gas based on a signal obtained from the oxygen density detecting means in such a manner that an oxygen amount supplied through the air supply pipe is adequate to form the mixture of a desired air-fuel ratio.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
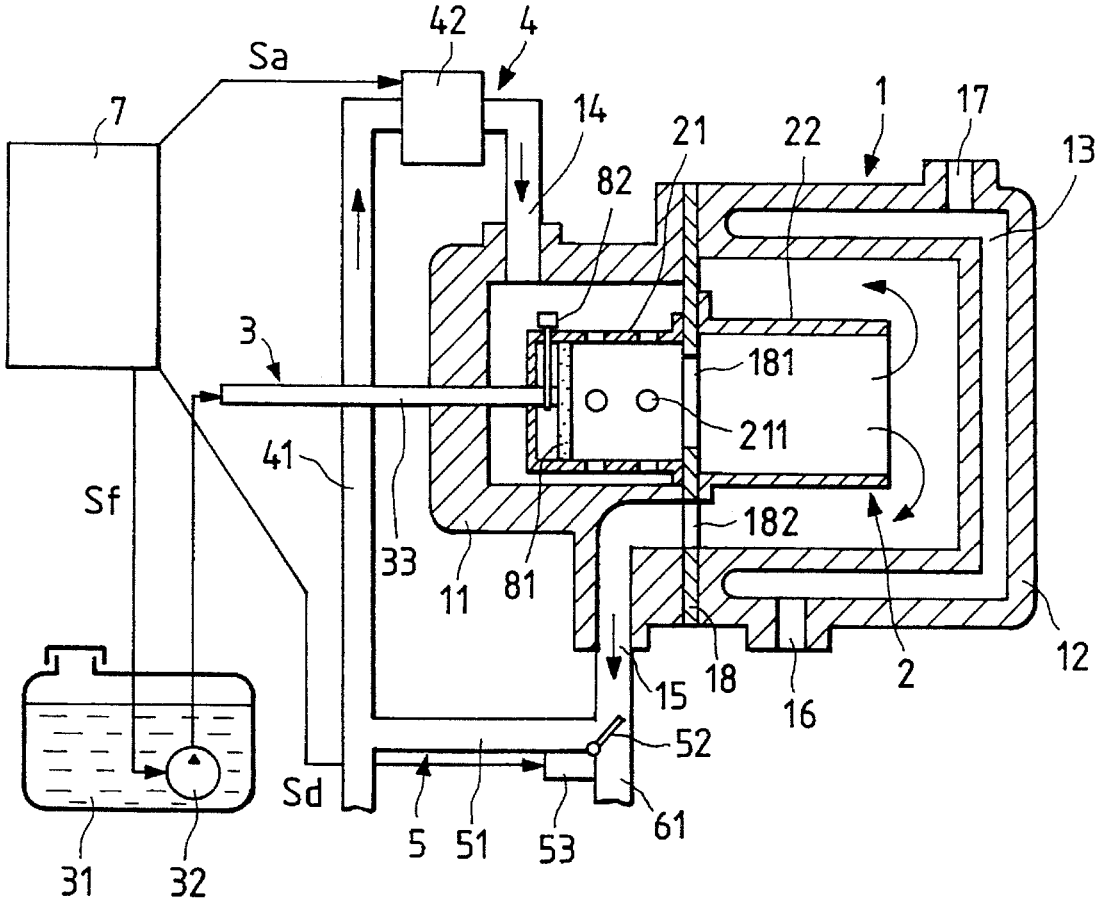
FIG. 1 is a cross-sectional view showing an overall arrangement of a fuel burning heater in accordance with a first embodiment of the present invention.

Preferred embodiments of the present invention will be explained in greater detail hereinafter, with reference to the accompanying drawings. Identical parts are denoted by identical reference numerals throughout views.

FIG. 1 is a cross-sectional view showing an overall arrangement of a fuel burning heater in accordance with a first embodiment of the present invention. In the drawing, a fuel burning heater has a housing 1 constituted by a left half body 11 and a right half body 12 mutually faced at their open ends and connected via a partition plate 18. The left half body 11 has an upper wall provided with an inlet port 14 and a lower wall provided with an exhaust port 15. The right half body 12 has a fluid passage 13 defined in a wall thereof. The fluid passage 13 is filled with water acting as heat transfer medium, the water entering from an inlet 18 provided on a lower wall thereof and exiting from an outlet 17 provided on an upper wall thereof.

A cylindrical burner 2, extending horizontally, is located centrally in an inside hollow space of the housing 1. More specifically, the burner 2 is separated into a mixing cylinder 21 and a burning cylinder 22 between which the partition plate 18 is interposed. In other words, the mixing cylinder 21 is disposed in a left chamber defined by the left half body 11 and the partition plate 18, while the burning cylinder 22 is disposed in a right chamber defined by the right half body 12 and the partition plate 18. The mixing cylinder 21 and the burning cylinder 22 are communicated each other by means of a through hole 181 provided centrally on the partition plate 18.

The burning cylinder 22 has a diameter larger than that of the mixing cylinder 21, and is communicated with the exhaust port 15 by means of another through hole 182 provided at a lower part on the partition plate 18. On the other hand, the mixing cylinder 21 is communicated with the inlet port 14, and has a distal end provided with a vaporization member 81 entirely extending normally to an axis of and across the mixing cylinder 21. A glow plug 82 is interposed between the distal end wall of the mixing cylinder 21 and the vaporization member 81, so that glow plug 82 is disposed adjacently to the vaporization member 81.

A fuel supply pipe 33 constituting part of fuel supply means 3 penetrates the side wall of the left half body 11. The front end of the fuel supply pipe 33 thoroughly penetrates the distal end wall of the mixing cylinder 21 and extends until it is brought into contact with the vaporization member 81.

The other end of the fuel supply pipe 33 is connected to a fuel pump 32 provided in a fuel tank 31. Furthermore, there are provided numerous air intake holes 211 on the cylindrical side wall of the mixing cylinder 21.

An air supply pipe 41, connected to the inlet port 14, is provided with an air pump 42 constituting part of air supply means 4. The air pump 42 is actuated based on a control signal Sa supplied from a control unit 7. The fuel pump 32 is also actuated based on a control signal Sf supplied from the control unit 7.

The air supply pipe 41 has a merging portion, provided upstream of the air pump 42, connected to one end of a circulating pipe 51 constituting part of circulating means 5. The other end of the circulating pipe 51 is connected to an exhaust pipe 61 communicating with and extending from the exhaust port 15 of the housing 1. In other words, the exhaust pipe 61 is bifurcated or divided at an appropriate branch portion along the exhaust gas flow into two pipes, the downstream part of the exhaust pipe 61 (i.e. a main passage of the exhaust pipe 61) and the circulating pipe 51 (i.e. a branch passage of the exhaust pipe 61).

A damper 52 is provided at the branch portion of the exhaust pipe 61. The damper 52 is open or close controlled by an actuator 53 in accordance with a control signal Sd supplied from the control unit 7. When the damper 52 is positioned at a nearly-full-open position as shown in the drawing, exhaust gas emitted from the burner 2 is almost recirculated into the air supply pipe 41 by way of the circulating pipe 51. In this manner, by changing the opening angle of the damper 52, the amount of exhaust gas circulated through the circulating pipe 51 into the air supply pipe 41 can be varied flexibly.

Figures 2A, 2B, 2C, 2D:
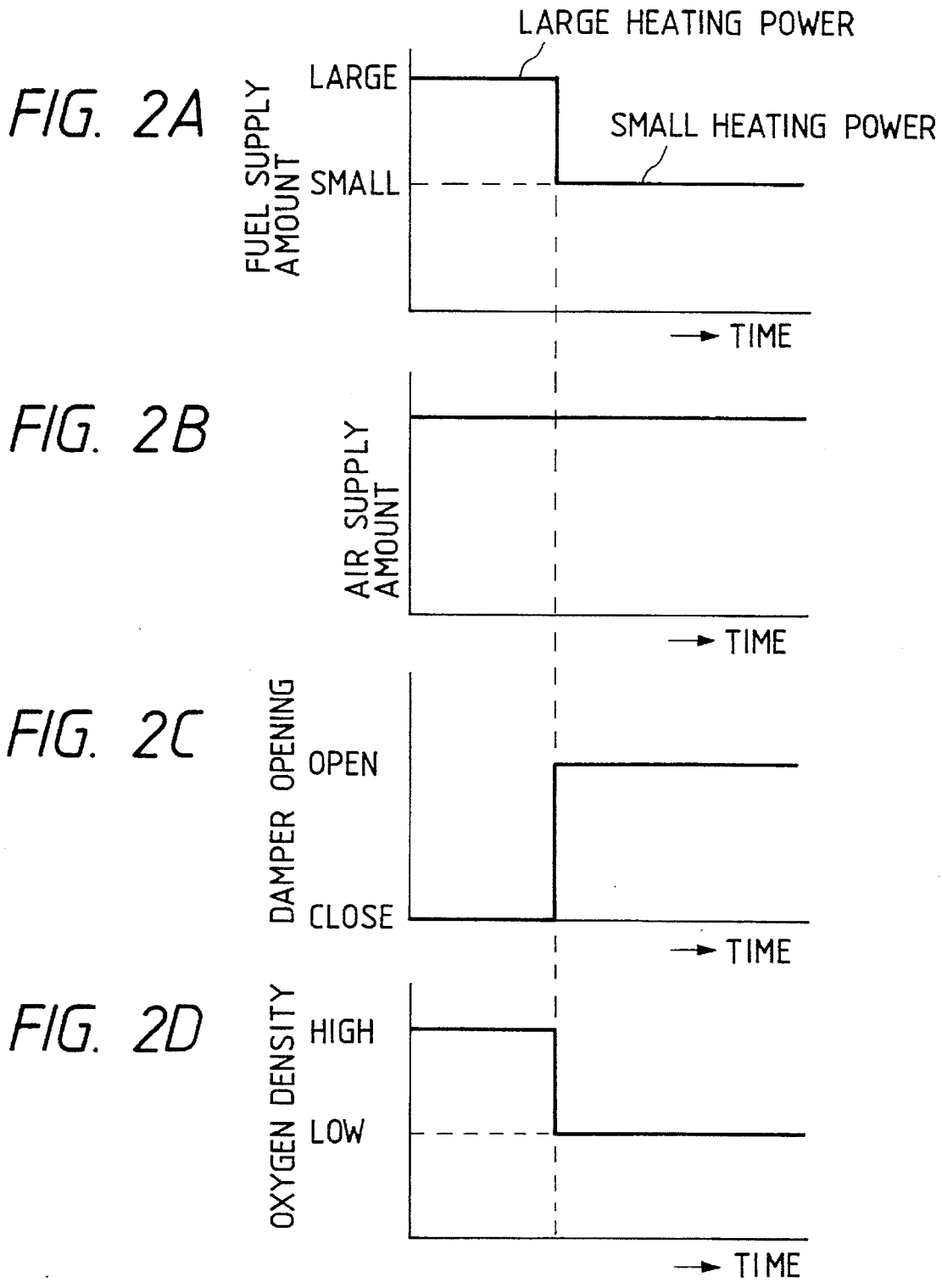
FIGS. 2A through 2D are time charts showing changes of and relationship between various factors in the control of the fuel burning heater in accordance with the first embodiment of the present invention.

In the above arrangement, it is now supposed that the large heating power is required. In response to this requirement, the control unit 7 increases the rotational speed of the fuel pump 32 at a predetermined high speed to supply a large amount of fuel into the burner 2, as shown in FIG. 2A (left part of the graph). Meanwhile, the air pump 42 is rotated at a predetermined rotational speed which is appropriate to supply the burner 2 with an air amount comparable with and fitting to the fuel amount supplied by the fuel pump 32, so as to maintain an appropriate burning condition, as shown in FIG. 2B. In this case, the damper 52 is positioned at a predetermined close position, as shown in FIG. 2C (left part of the graph). Thus, no exhaust gas is circulated through the circulating pipe 51 to the air supply pipe 41. The oxygen density in the air supplied to the burner 2 is maintained at a predetermined high value just fitting to perfectly burn the supplied fuel, as shown in FIG. 2D (left part of the graph).

On the other hand, when the small heating power is required, the control unit 7 decreases the rotational speed of the fuel pump 32 at a predetermined low speed to supply a small amount of fuel into the burner 2, as shown in FIG. 2A (right part of the graph). Meanwhile, the rotational speed of the air pump 42 is maintained at the same predetermined rotational speed regardless of change of rotational speed of the air pump 42, as shown in FIG. 2B. Accordingly, the total volume of fluid introduced into the burner 2 remains at a constant value. In this case, the damper 52 is positioned at a predetermined open position, as shown in FIG. 2C (right part of the graph), so as to allow exhaust gas in the exhaust gas pipe 61 to enter the air supply pipe 41 by way of the circulating pipe 51. Thus, the fluid actually introduced in the mixing cylinder 21 is the gas mixture of flesh air and circulated exhaust gas. Accordingly, the oxygen density in the fluid supplied to the burner 2 is reduced to a low value in proportion to the amount of recycled exhaust gas. In other words, the control unit 7 controls the damper 52 in such a manner that the oxygen density supplied to the burner 2 is reduced in proportion to the reduction of the amount of fuel supplied into the burner. Thus, the oxygen density is adjusted (reduced) to perfectly or ideally burn the supplied fuel without causing instable combustion or increase of harmful emission, as shown in FIG. 2D (right part of the graph).

The above arrangement and control enable it possible to properly maintain the fuel burning condition at a desirable condition so as not to induce an excessive air supplying condition (i.e. an oxygen rich condition) with respect to the supplied fuel when the fuel supply amount is reduced. Especially, the total fluid amount introduced into the burner 2 (i.e. mixing cylinder 21) is not varied no matter how much the fuel supply amount is reduced. Thus, it becomes possible to maintain the burning condition of the burner 2 free from instability due to reduction of air flow speed or pressure drop in the air supply pipe 41.

Figure 3:
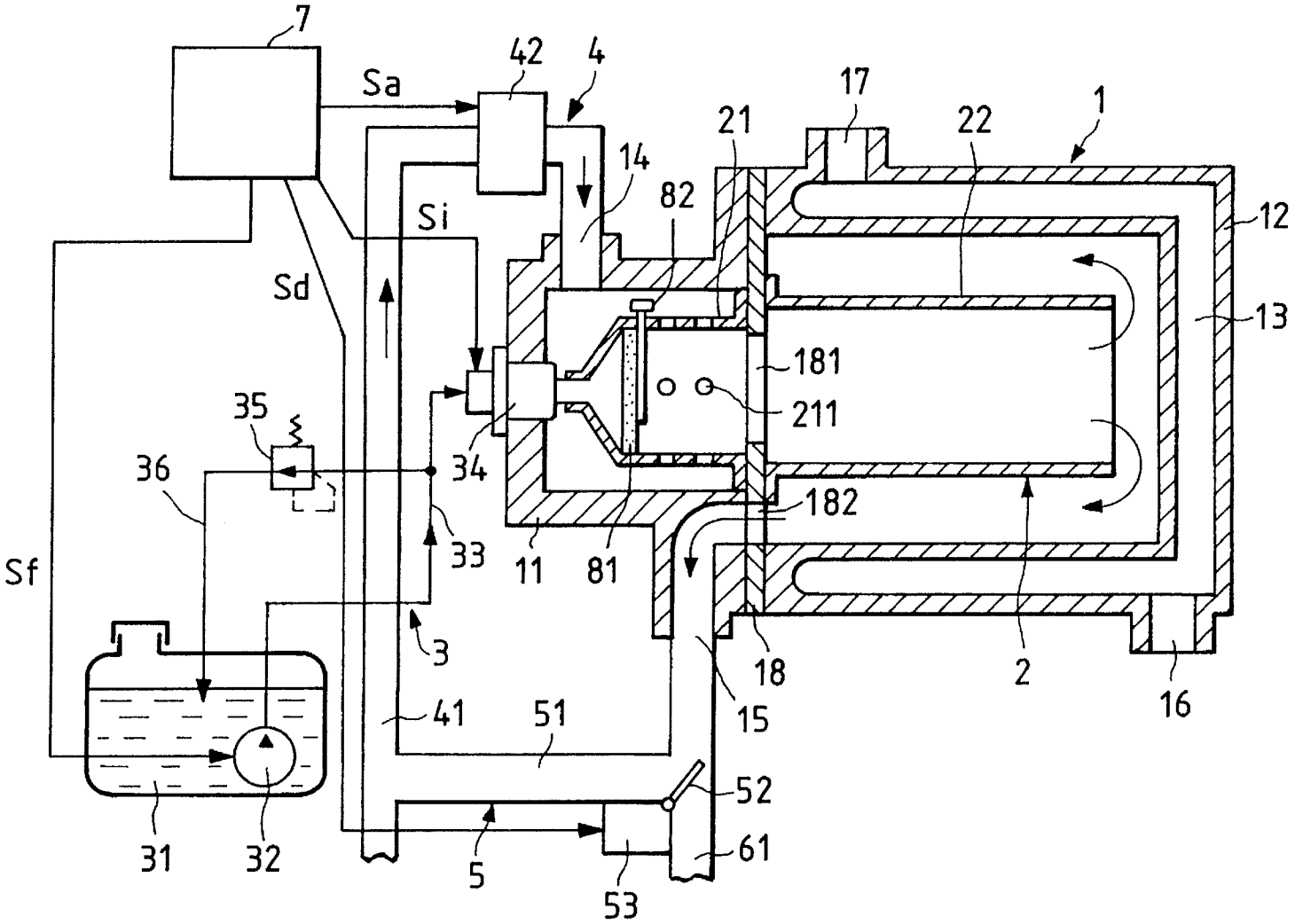
FIG. 3 is a cross-sectional view showing an overall arrangement of a fuel burning heater in accordance with a second embodiment of the present invention.

FIG. 3 is a cross-sectional view showing an overall arrangement of a fuel burning heater in accordance with a second embodiment of the present invention. The second embodiment is different from the first embodiment in the construction of the fuel supply means 3. More specifically, an electromagnetically controlled fuel injection valve 34 is provided so as to penetrate the side wall of the left half body 11. The front end of the fuel injection valve 34 is inserted into the inside space of the mixing cylinder 21 through a small opening formed on the side wall of the mixing cylinder 21, so as to confront with the face of vaporization member 81. The fuel supply pipe 33 is connected at one end to the fuel injection valve 34 and connected at the other end to the fuel pump 32, with an intermediate portion branched into a return pipe 36 provided with a pressure regulating valve 35. The fuel injection valve 34 is activated in response to a duty-pulse signal Si supplied from the control unit 7, so that a required amount of injection fuel is uniformly supplied on the face of vaporization member 81. The glow plug 82 is not disposed between the distal end wall of the mixing cylinder 21 and the vaporization member 81; however, the function of the glow plug 82 is the same as that of the first embodiment because the glow plug 82 is disposed adjacently to the vaporization member 81.

The control of the second embodiment is the same as that of the first embodiment which is already explained in the forgoing description with reference to FIGS. 2A through 2D.

Figure 4:
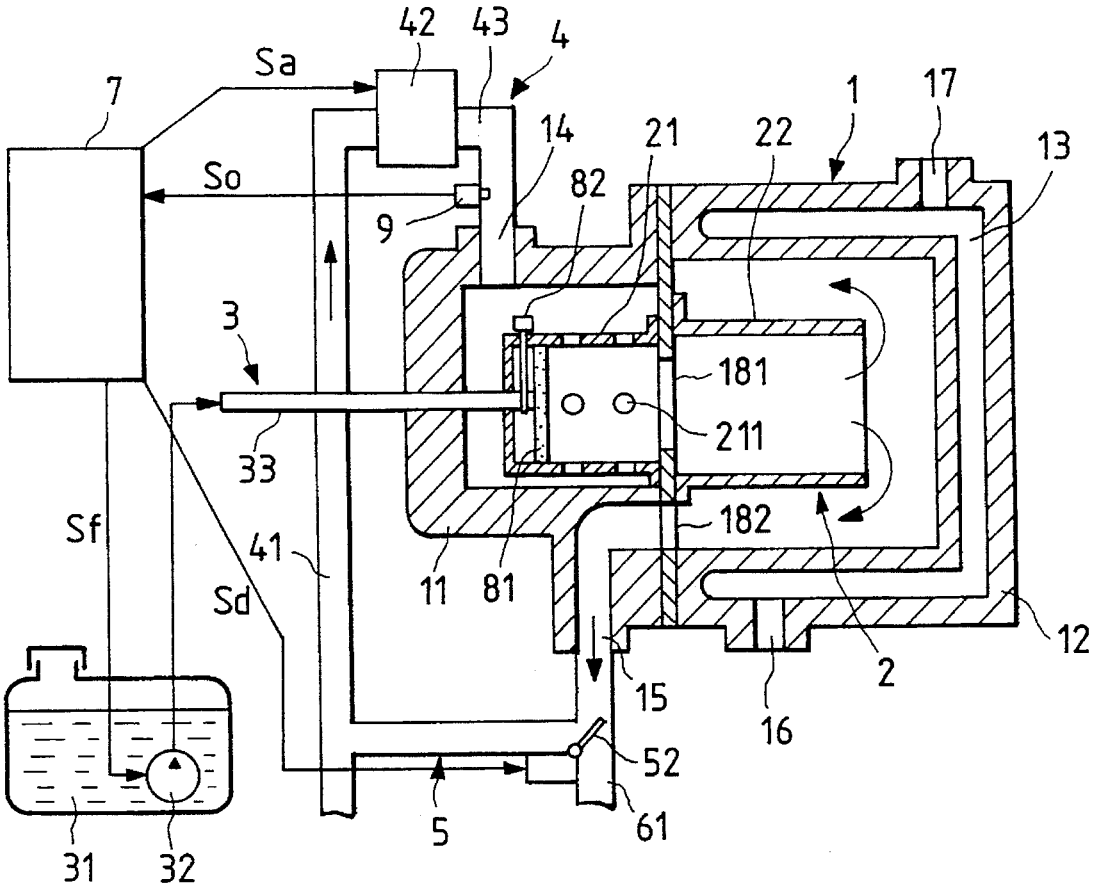
FIG. 4 is a cross-sectional view showing an overall arrangement of a fuel burning heater in accordance with a third embodiment of the present invention.
Figure 5:
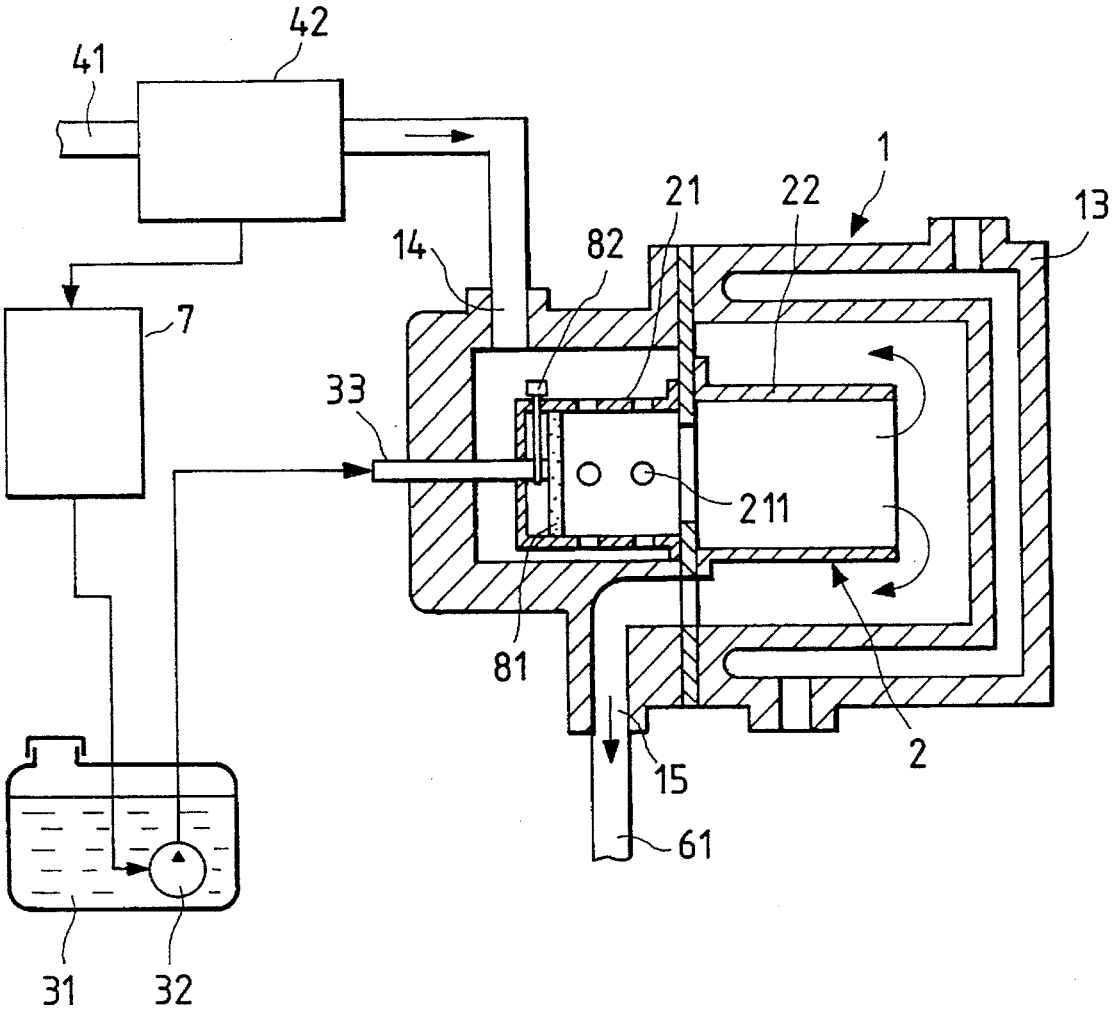
FIG. 5 PRIOR ART
FIG. 5 is a cross-sectional view showing an overall arrangement of a conventional fuel burning heater.
Figure 6A:
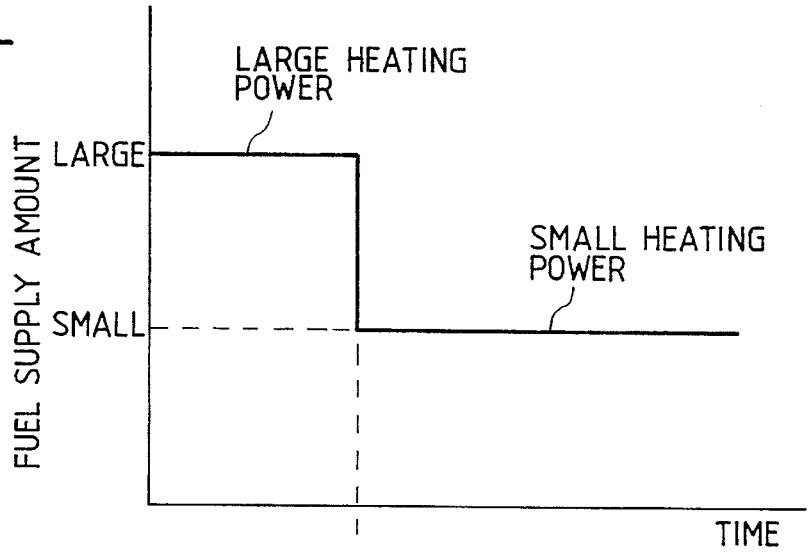
FIG. 6A PRIOR ART
FIGS. 6A and 6B are time charts showing changes of and relationship between fuel supply amount and air supply amount in the conventional fuel burning heater.
Figure 6B:
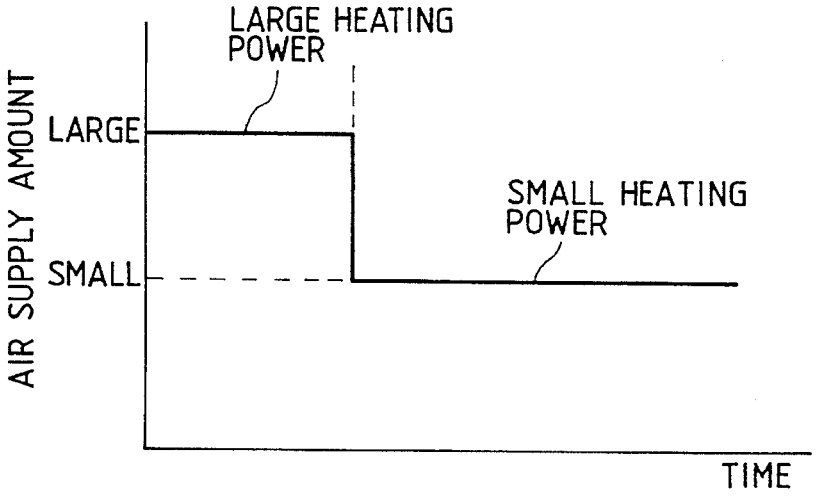
FIG. 6B PRIOR ART

FIG. 4 is a cross-sectional view showing an overall arrangement of a fuel burning heater in accordance with a third embodiment of the present invention. The third embodiment is different from the first embodiment in that an oxygen sensor 9 is additionally provided downstream of the air pump 42 in the air supply pipe 41 (i.e. the downstream air supply passage 43). An output signal So of the oxygen sensor 9, representing an oxygen density in the air supply pipe 41 (i.e. downstream air supply passage 43), is supplied to the control unit 7 to feedback control the oxygen density of the mixture introduced into the burner 2 at a desired value. Thus, when the small heating power is required, the control unit 7 open or close controls the damper 52 to adjust the circulation amount of exhaust gas in such a manner that an oxygen amount supplied through the air supply pipe 41 is just fitted to the supplied fuel to form gas mixture of an ideal air-fuel ratio for combustion, while maintaining the total volume of fluid introduced into the burner 2 at a constant value. Hence, according to this arrangement of the third embodiment, it becomes possible to accurately control the burning condition in the burner 2.

Although, the control of heating power described in the above embodiments is based on the simple two-level, large and small, switching operation, it is needless to say that the heating power can be more finely adjustable.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A fuel burning heater comprising:

a housing having a member defining a fluid passage;

a burner disposed within said housing, said burner being capable of heating a fluid contained in said fluid passage;

fuel supply means for supplying fuel into said burner;

air supply means for supplying air into said burner, said air supply means including an air supply pipe;

exhaust gas circulating means for circulating exhaust gas, produced in said burner by combustion of an air-fuel mixture, to said air supply pipe, circulating amount control means for controlling a total amount of said air and said exhaust gas supplied to said burner such that the total amount is maintained at a constant value, regardless of any change to an amount of fuel supplied by said fuel supply means.

2. The fuel burning heater defined by claim 1, wherein said circulating amount control means increases an amount of said exhaust gas circulated by said exhaust gas circulating means when the amount of said fuel supplied by said fuel supply means is reduced so as to maintain the total amount of said air and said exhaust gas flowing in said air supply pipe at a constant value regardless of change of the amount of said fuel supplied by said fuel supply means.

3. The fuel burning heater defined by claim 1, wherein said exhaust gas circulating means comprises a circulating pipe for circulating said exhaust gas from an exhaust pipe to said air supply pipe, and an open-and-close valve for adjusting a circulation amount of said exhaust gas circulated through said circulating pipe.

4. The fuel burning heater defined by claim 1, further comprising an oxygen density detecting means for detecting an oxygen density in said air supply pipe, wherein said circulating amount control means controls said exhaust gas circulating means to adjust the circulation amount of said exhaust gas based on a signal obtained from said oxygen density detecting means in such a manner that an oxygen amount supplied through said air supply pipe is adequate to form the mixture of a desired air-fuel ratio.

5. The fuel burning heater defined by claim 4, wherein said circulating amount control means maintains a total volume of said air and said exhaust gas at a constant value when said air and said exhaust gas are introduced into said burner through said air supply pipe.

6. A fuel burning heater comprising:

a housing having a member defining a fluid passage;

a burner disposed within said housing, said burner being capable of heating a fluid contained in said fluid passage;

fuel supply means for supplying fuel into said burner;

air supply means for supplying air into said burner, said air supply means including an air supply pipe;

an air pump disposed in said air supply pipe;

exhaust gas circulating means for circulating exhaust gas, produced in said burner by combustion of an air-fuel mixture, to said air supply pipe, said exhaust gas circulating means including an exhaust gas circulating pipe connected to said air supply pipe at a portion upstream of said air pump and an adjusting member for adjusting a circulating amount of said exhaust gas circulated through said exhaust gas circulating pipe; and circulating amount control means for controlling said adjusting member of said exhaust gas circulating means so as to increase the circulating amount of said exhaust gas when an amount of said fuel supplied by said fuel supply means is reduced, while a total amount of said air and said exhaust gas supplied together through said air supply pipe into said burner is maintained at a constant value regardless of a change in fuel supply amount.

7. The fuel burning heater defined by claim 6, wherein said circulating amount control means controls said adjusting member of said exhaust gas circulating means in such a manner that an oxygen density of said air and said exhaust gas supplied through said air supply pipe to said burner is reduced in proportion to a reduction of the amount of said fuel supplied by said fuel supply means.

8. The fuel burning heater defined by claim 6, further comprising an oxygen density detecting means provided downstream of said air pump for detecting an oxygen density of said air and said exhaust gas supplied together through said air supply pipe, wherein said circulating amount control means controls said adjusting member of said exhaust gas circulating means to adjust the circulation amount of said exhaust gas based on a signal obtained from said oxygen density detecting means in such a manner that an oxygen amount of said air and said exhaust gas supplied together through said air supply pipe is adequate to form the mixture of a desired air-fuel ratio.

9. A fuel burning heater comprising:

a housing having a member defining a fluid passage;

a burner disposed within said housing, said burner being capable of heating a fluid contained in said fluid passage;

fuel supply means for supplying fuel into said burner;

air supply means for supplying air into said burner, said air supply means including an air supply pipe;

exhaust gas circulating means for circulating exhaust gas, produced in said burner by combustion of an air-fuel mixture supplied by said fuel supply means and said air supply means, to said air supply pipe; and compensating means for increasing an amount of said exhaust gas circulated by said exhaust gas circulating means when an amount of said fuel supplied by said fuel supply means is reduced, so as to reduce an amount of said air introduced into said burner in proportion to the reduction of the amount of said fuel supplied by said fuel supply means, without changing a total amount of said air and said exhaust gas supplied together through said air supply pipe into said burner.

10. The fuel burning heater defined by claim 9, wherein said exhaust gas circulating means comprises a circulating pipe for circulating said exhaust gas from an exhaust pipe to said air supply pipe, and an open-and-close valve for adjusting a circulation amount of said exhaust gas circulated through said circulating pipe.

11. The fuel burning heater defined by claim 9, further comprising an oxygen density detecting means for detecting an oxygen density of said air and said exhaust gas in said air supply pipe, wherein said compensating means controls said exhaust gas circulating means to adjust a circulation amount of said exhaust gas based on a signal obtained from said oxygen density detecting means in such a manner that an oxygen amount supplied through said air supply pipe is adequate to form the mixture of a desired air-fuel ratio.

* * * * *